US005473850A

United States Patent [19]

Balding

[11] Patent Number: 5,473,850

[45] Date of Patent: Dec. 12, 1995

[54] ONE-PIECE PLASTIC MOLDING BLOCK FOR CONCRETE STRUCTURES

[76] Inventor: James Balding, 11925 Koenegstein, Santa Paula, Calif. 93060

[21] Appl. No.: 11,701

[22] Filed: Feb. 1, 1993

[51] Int. Cl.[6] ..... E04B 2/00

[52] U.S. Cl. ..... 52/426; 52/439; 52/568; 52/581

[58] Field of Search ..... 52/439, 425, 426, 52/415, 581, 442, 645, 568

[56] References Cited

U.S. PATENT DOCUMENTS

| | | | |
|---|---|---|---|
| 136,407 | 3/1873 | Beschke | 52/439 |
| 1,949,079 | 2/1934 | Loeffler | 52/439 X |
| 3,788,020 | 1/1974 | Gregori | 52/439 X |
| 4,004,385 | 1/1977 | Kosuge | 52/439 X |
| 4,439,967 | 4/1984 | Dielenberg | 52/439 X |
| 4,706,429 | 11/1987 | Young | 52/426 X |
| 4,889,310 | 12/1989 | Boeshart | 52/426 X |
| 4,967,528 | 11/1990 | Doran | 52/426 X |
| 5,014,480 | 5/1991 | Guarriello et al. | 52/439 X |

*Primary Examiner*—Lanna Mai
*Attorney, Agent, or Firm*—Richard T. Lyon

[57] ABSTRACT

A one-piece, durable plastic block for forming concrete structures wherein uncured concrete is poured into the block which has been laid in brick-like fashion with a plurality of similar blocks, and where the block becomes an integral part of the resulting concrete structure providing strength thereto. The block has a generally rectangular shaped housing with an open top and bottom. Lateral tensive strengthening is provided by a plurality of cross straps disposed across the open top and bottom of the block and include a connecting device to attach to overlying or underlying blocks. Each end wall of the block has a connecting device for attaching it to the end wall of an adjacently placed block. There is also a notch at the top and bottom of each end wall providing for the continuity of concrete between blocks and to allow the installation of reinforcing bars across this interface. The block is made of a plastic material which is sufficiently durable as to allow it to be as thin as possible and still strong enough to retain the uncured concrete. One version of this invention is foldable such that a first side wall and end wall pair will lie practically flat against the second side wall and end wall pair to facilitate packaging, shipping and storage. Another version of this invention allows attachment of facing materials either by a series of perforations to allow the application of plaster-type materials, or a pin and hole arrangement for panel-type materials.

10 Claims, 4 Drawing Sheets

ONE-PIECE PLASTIC MOLDING BLOCK FOR CONCRETE STRUCTURES

BACKGROUND OF THE INVENTION

1. Technical Field

The present invention relates generally to the construction of concrete structures, and more particularly to the construction of those structures using concrete molding blocks.

2. Background Art

The construction of concrete structures such as building foundations and walls was traditionally accomplished using removable forms into which uncured concrete is poured, or by the laying and mortaring together, in brick-like fashion, a series of cement blocks. These methods require the hard to master skills of an experienced professional. This is one factor causing construction by these methods to be expensive.

In the building of a structure using concrete forms, the structure is made by assembling a series of braced wood or metal walls in the desired shape of the finished wall, foundation, etc. Once the concrete has been poured into the forms and cured, the forms must be removed, cleaned, and repaired prior to transporting them away from the construction site. As can be imagined, not only does this system require skilled workers to assemble to forms properly, but it is also costly in terms of the time consumed to set-up and disposition the concrete forms. On top of all that, add the expense of transportation and storage. The form sections have to be shipped to the construction site and then stored prior to assembly. The sections being made of wood or metal are too heavy to be lifted by hand, so the use of a forklift or crane is required to remove them from the delivery trucks or to bring them from on-site storage to the location where the concrete structure is to be built. Typically, the number of forms required and their size dictates that more than one truck be used to bring them to the work site. Additionally, to incorporate structural features, such as windows, electrical outlets, wiring, plumbing, and the like the forms have to be cut. As the structural features of a building are usually unique to that building, the modified form can not be used for future construction jobs, except possibly as scrap that can be further modified to fit some structural feature of that job. And, once the forms have been removed, the concrete is exposed to the elements. This can require the installation of insulating materials to satisfactorily maintain the temperature of the interior of the structure. Also, the exposed concrete is susceptible to cracking which can cause water and air leaks into the structure. And finally, the removed forms have to be cleaned, restored, and eventually shipped out of the construction site.

Cement block construction methods present problems similar to concrete forms and a few disadvantages of their own. The blocks are stacked like bricks and mortared together. The mortar joints are susceptible to cracking and so subject to air and water intrusion just like the formed concrete structures. In addition, the strength of a cement block structure is less than that of an all concrete equivalent because of the mortar joints and more susceptible to failure. The sight of a cement block wall cracked and crumbling along its mortar joints is not uncommon. Cement blocks structures are also poor insulators, so may require the addition of insulation to efficiently maintain the temperature of the interior of the building. Once stacked, the cement blocks must be cut to provide for the installation of electrical outlets, plumbing fixtures, and the like. This can only be accomplished with considerable difficulty as the cement must be sawed through to create the necessary openings. The cement blocks are bulky and heavy. Therefore, several trucks may be required to transport them to the construction site, and once there, any movement of more than one or two individual blocks must be accomplished with the use of a forklift or crane. And, just as in the case of the concrete forms, the blocks would require on-site storage since it can take several days to complete a cement block structure. Although no removal and form cleaning is required as with concrete forms, there is still some cleaning associated with cement block construction methods. As stated, it can take several days to construct a cement block structure. After each day, the unfinished ends of a the cement blocks must be carefully cleaned of excess mortar, as it will harden overnight thereby interfering with the lying of additional blocks the next day. Also, once construction begins, the shape of the structure can not be rearranged without demolishing the already laid and mortared blocks. Therefore, little flexibility exists in this construction method. And, finally, the level of skill required to construct a cement block wall is even higher than with one made with concrete forms. Accordingly, the labor costs can be even higher.

Recently, styrofoam molding blocks have been introduced as an alternative method of constructing concrete structures. Typically, these hollow blocks are stacked in a brick-like fashion similar to the cement blocks. However, they are not mortared together. Instead, concrete is poured into the hollow centers of the blocks. Usually, the styrofoam exterior is left in place. Although, these type of blocks offer some advantages over the concrete forms and cement block construction methods, they present disadvantages as well. They are not heavy, but they are still bulky. This means that several trucks are still required to transport sufficient quantities of the blocks to the construction site. The fact that the blocks are made of styrofoam or some other plastic foam material creates several problems related to their strength. First, they are easily damaged during transport and handling. Therefore, the number of unusable blocks can be high. These type of blocks usually have integrally formed interconnections. However, these interconnections are typically not strong enough to support the structure once the concrete is poured in, therefore, the structure must be braced prior to the pouring. Additionally, the foam materials used to make the blocks have almost no shear strength. Accordingly, they provide no resistance to cracking of the concrete. This lack of resistance follows from the fact that a crack in concrete only propagates if its point of origin on the surface can widen. The foam offers no resistance to this widening as the material shears easily. Also, to provide enough strength not to burst under the force put on the foam block by the uncured concrete poured inside, the foam must be somewhat thick. Typically, the walls of the block can be two inches thick or more. This presents some unique problems. The sections of the structure that form the perimeter of features such as windows and doors necessarily have two inches of foam material between the concrete inside the block and the door or window frame. Someone could chisel through the foam without much difficulty and access the interior of the structure. With such a hole, a door or window could be unlocked and the structure burglarized. The thickness of the foam also makes attachment of facing materials difficult. Any panel-like facing must be attached to studs or the like which have been pre-positioned in the concrete and which are long enough to extend through the foam, or must be pounded into the concrete while leaving at least two inches of the stud's shaft protruding through the foam. As can be imagined the shaft of such a stud would have to be unusually thick to allow the cantilevering of a facing panel two inches away from its anchoring point. The other alternative would be to glue the facing panel to the foam surface. However, this would provide little structural strength. The panel could literally be pulled free taking a portion of the foam with it. Such a method would be particularly unsuitable for exterior facings, or heavy facing materials such as brick of rock. And for plaster type facings, such as stucco, a backing board would have to be installed by one of the above mentioned methods before it could be applied. The thickness of the foam also makes the doubling of the blocks to create a deeper structure impractical as there would be four inches of foam between the concrete portions of the structure. Any joining of the foam surfaces would be useless in providing structural integrity between the concrete sections of such a wall, and any mechanical interconnection would have to bridge four inches of foam.

Wherefore, it is an object of this invention to provide an apparatus for the construction of monolithic concrete structures which comprises the use of a light weight, one-piece, thin-walled, durable plastic concrete molding block which initially provides for quick, reconfigurable, low skilled assembly, sufficient burst and interconnection strength to be free-standing without the need for bracing, and which becomes an integrated part of the structure thereby providing high shear strength and insulating properties thereto.

Wherefore, it is another object of this invention to provide for a foldable concrete molding block such that it can be collapsed to minimize the space requirements necessary for its shipping and storage.

Wherefore, it is still another object of this invention to provide for a concrete molding block which facilitates the installation of all types of facing materials.

SUMMARY OF THE INVENTION

The present invention is directed to a device that resolves the above-described disadvantages of current concrete construction methods. The device comprises a one-piece, durable plastic block for forming concrete structures wherein uncured concrete is poured into the block and the block becomes an integral part of the resulting concrete structure providing strength thereto. The block includes a generally rectangular shaped housing having an open top and bottom including a pair of side walls forming the longer sides of the block and a pair of end walls forming the shorter sides of the block, a means for providing lateral tensive strengthening to the block and wherein the block is made of a plastic material which is sufficiently durable as to allow it to be as thin as possible and still strong enough to retain the uncured concrete. The durable plastic construction eliminates the damage during shipping and handling experience with foam blocks. In addition the plastic's durability creates a strong resistance to shearing such that leak causing cracks in the concrete are no longer a concern. The plastic is also strong enough to resist the bursting forces of uncured concrete but is thin so as to eliminate the unauthorized entry problem of the foam block method. The thinness and durability of the material also allows for the direct attachment of panel-type facing materials to a hard surface thereby alleviating the attachment problems experience with the foam blocks. These blocks can be laid in a double thickness pattern without the problems of the foam interface. And, unlike the concrete structures made with forms, or a cement block structure, the plastic blocks of this invention can be easily cut to accommodate structural features prior to pouring the concrete without any waste. The integrated plastic material also provides an insulative quality to the finished structure which can eliminate the need for additional insulation. And there is no need to remove, clean and repair any forms because the block becomes part of the structure.

The lateral tensive strengthening means includes a plurality of cross straps disposed across the open top of the block in the direction of the shortest width, the ends of which are attached to an edge of opposing side walls, and a plurality of cross straps disposed across the open bottom of the block in the direction of the shortest width, the ends of which are also attached to an edge of opposing side walls, and which are identical in number and longitudinal location as the cross straps disposed across the open top of the block. In one version of the invention there are four such cross straps disposed across each the open top and bottom of the block, where each cross strap disposed over the open top of the block has a first means for connecting it to the cross strap of an overlying block, and each cross strap disposed over the open bottom of the block has a second means for connecting it to the cross strap of an underlying block. Each of the first cross strap connecting means is identical to the second cross strap connecting means, and includes a through hole, and a perpendicularly protruding pin on the exterior facing surface of the cross strap, capable of creating an interference fit with the through hole of the cross strap of an adjacently placed block, and extending slightly into the interior thereof. The through hole and pin are diametrically opposed to each other along the longitudinal centerline of the cross strap and equidistant from the center of that line. The first two of the cross straps that are disposed over the open top of the block are affixed along the block's longitudinal direction such that their longitudinal centerlines are equidistant from a point which is one-quarter the longitudinal length of the block from one of its ends, and the centerlines are spaced apart a distance equal to the separation of the centers of the pin and the through hole on each of the first two of the cross straps. The second two cross straps are affixed identically as the first two except from the opposite end of the block. The cross straps disposed over the open bottom of the block are positioned so as to mirror the cross straps disposed over the open top of the block. This placement pattern ensures the through hole of a block's cross strap will interface with the corresponding pin of an overlying or underlying block, and similarly each pin will interface with the through hole of an overlying or underlying block.

Each end wall in the above mentioned version of the invention has a means for connecting it to the end wall of an adjacently placed block. This end wall connecting means includes a through hole and a perpendicularly protruding pin on the exterior facing surface of the end wall, capable of creating an interference fit with the through hole of an adjacently placed block, and extending slightly into the interior thereof. The through hole and pin are diametrically opposed to each other along the horizontal centerline of the end wall and equidistant from the center of that line.

The cross strap and end wall connection means are used to connect a plurality of the molding blocks together to form the framework for the concrete structure. The blocks are stacked in brick-like fashion where each block in a row is abutted end to end so that the end wall connection means are horizontally locked together, and each overlying or underlying block is staggered such that only one-half of its longitudinal length overlaps a block in the adjacent upper or lower row. This pattern results in some of the overlying and underlying blocks at the end of a row being at a 90 degree angle with one-half of its longitudinal length forming the end of a row of blocks along one face of the structure, and the other half forming the beginning of the row on the adjacent face. The cross strap connection means of vertically adjacent blocks lock together to ensure the overlying and underlying blocks are securely fastened to the middle-lying block.

The interconnecting feature has several advantages. First, the blocks snap together to form the framework for the structure. Alignment and placement problems are eliminated. There is no need for skilled masons or form builders. Accordingly, unskilled labor can be employed to construct the structure quickly and efficiently, thereby reducing costs. The one piece construction of the block further simplifies assembly. The snap-together interconnections provide sufficient strength to eliminate the need for bracing, thereby reducing labor cost even more. If it is decided to alter the shape of the structure, the blocks can be easily unfastened and moved any time before the concrete is poured. The blocks are also light. Accordingly, they can be moved by hand and without risk of injury to the worker as exist with forms and cement blocks. The need for forklifts and cranes is eliminated.

The aforementioned version of the invention also includes an identically located notch at the top and bottom of each end wall providing for the continuity of concrete between blocks where the notch of a first block interfaces with the notch of a horizontally adjacent second block and to allow the installation of reinforcing bars across this interface in the longitudinal direction thereby strengthening the interconnection between individual blocks by creating a monolithic nature to the structure. This monolithic nature of the structure, and the fact that the end walls of the blocks abut each other directly leaving no space between, also eliminates the problems associated with the failure of mortar joints or seams common with the cement block structures. There also exists an end plate which includes means to connect to the end wall so that a notch can be covered to prevent the escape of uncured concrete from an end wall facing the exterior of the concrete structure.

This version of the invention also has an attached, identically located, strengthening rib which protrudes perpendicularly into the interior of the block from each end and side wall, which is disposed longitudinally along the middle of the interior facing surface of the wall, thereby providing resistance against longitudinal bowing.

Another version of this invention including a means on the exterior surfaces of the concrete structure to allow attachment of facing materials. In one variation, the side walls and end walls are perforated such that the perforations are sized so that uncured concrete is allowed to flow partially through a perforation, but not completely through to the exterior facing surface of the block, but the number of the perforations are few enough to ensure the block retains sufficient strength to hold the uncured concrete without rupturing. A plaster-type facing material can then be applied to the exterior surface filling the remaining void within the perforations thereby bonding to the partially exuded concrete. This feature eliminates the need for a backing panel as required with the foam blocks. In another variation, the facing material attachment means includes either through holes which interface with pins on the back surface of panel-type facing materials, or pins which interface with holes in the back surface of panel-type facing materials. This feature greatly facilitates the attachment and replacement of such facing materials.

In still another version of the invention perforations in those side walls and end walls which are intended to abut other blocks are alternately sized so that uncured concrete is allowed to flow completely through the perforations where it can fuse with concrete exuded by the other abutted blocks to further strengthen the interconnection between individual blocks by creating a more monolithic nature to the structure. However, the number of the perforations are few enough to ensure the block still retains sufficient strength to hold the uncured concrete without rupturing.

In a foldable version of the invention the block is foldable such that a first side wall and end wall pair will lie practically flat against the second side wall and end wall pair to facilitate packaging, shipping and storage. The need for a multitude of delivery trucks and large amounts of on-site storage are eliminated because of the compact nature of this version of the invention. The foldable block includes a means for hingedly connecting the side wall to an adjacent end wall such that the interior facing surface of the side wall is capable of rotating in relation to the interior facing surface of the end wall to form either a 90 degree angle, 180 degree angle, or 360 degree angle, where the 90 degree angle corresponds to an unfolded position, and the 180 and 360 degree angles correspond to a folded position. In addition, each cross strap includes a first piece and a second piece, each of which extends from the attachment to its respective side wall and is joined to the other by a means for locking the two pieces of the cross strap together. The cross strap attachment includes a means for hingedly connecting the end of each piece of each cross strap to its respective side wall edge such that the interior facing surface of each cross strap piece is capable of rotating in relation to the interior facing surface of its adjacent side wall to form either a 90 degree angle or a 180 degree angle, where the 90 degree angle corresponds to the unfolded position and the 180 degree angle corresponds to the folded position. In one variation of the invention the connecting means between the side wall and an adjacent end wall, and the connecting means between each cross strap piece and its adjacent side wall, is a living hinge. The locking means between the two pieces of each cross strap includes, an integrally formed stud protruding perpendicularly from the interior facing surface of the first piece of the cross strap at a free end, wherein the stud is elastically deformable and whose sides taper inward slightly from its end, and a receiving through hole at the free end of the second piece of the cross strap whose perimeter matches the cross sectional shape of the stud at its end, but is slightly smaller. Also the interior facing surface of the free end of the first piece of the cross strap containing the stud is recessed one-half the thickness of the cross strap, and the exterior facing surface of the free end of the second piece of the cross strap containing the receiving through hole is recessed one-half the thickness of the cross strap, such that when the two pieces of the cross strap are locked together the recessed surface of the first cross strap piece contacts the recessed surface of the second cross strap piece resulting in a flat, continuous surface on each face of the locked cross strap. The strengthening rib in this version of the invention protrudes perpendicularly into the interior of the block and is disposed longitudinally along approximately the middle of the interior facing surface of each side and end wall, as before, except here the vertical height at which the strengthening rib on the side wall is disposed is offset from the vertical height at which the strengthening rib on the end wall is disposed so that they overlap when the block is in the folded position. In addition, each end of the rid on the side wall and each end of the rib on the end wall is tapered so that folding of the block is not significantly interfered with.

BRIEF DESCRIPTION OF THE DRAWINGS

These and other features, aspects, and advantages of the present invention will become better understood with regard to the following description, appended claims, and accompanying drawings where:

DETAILED DESCRIPTION OF THE INVENTION

Figure 1:
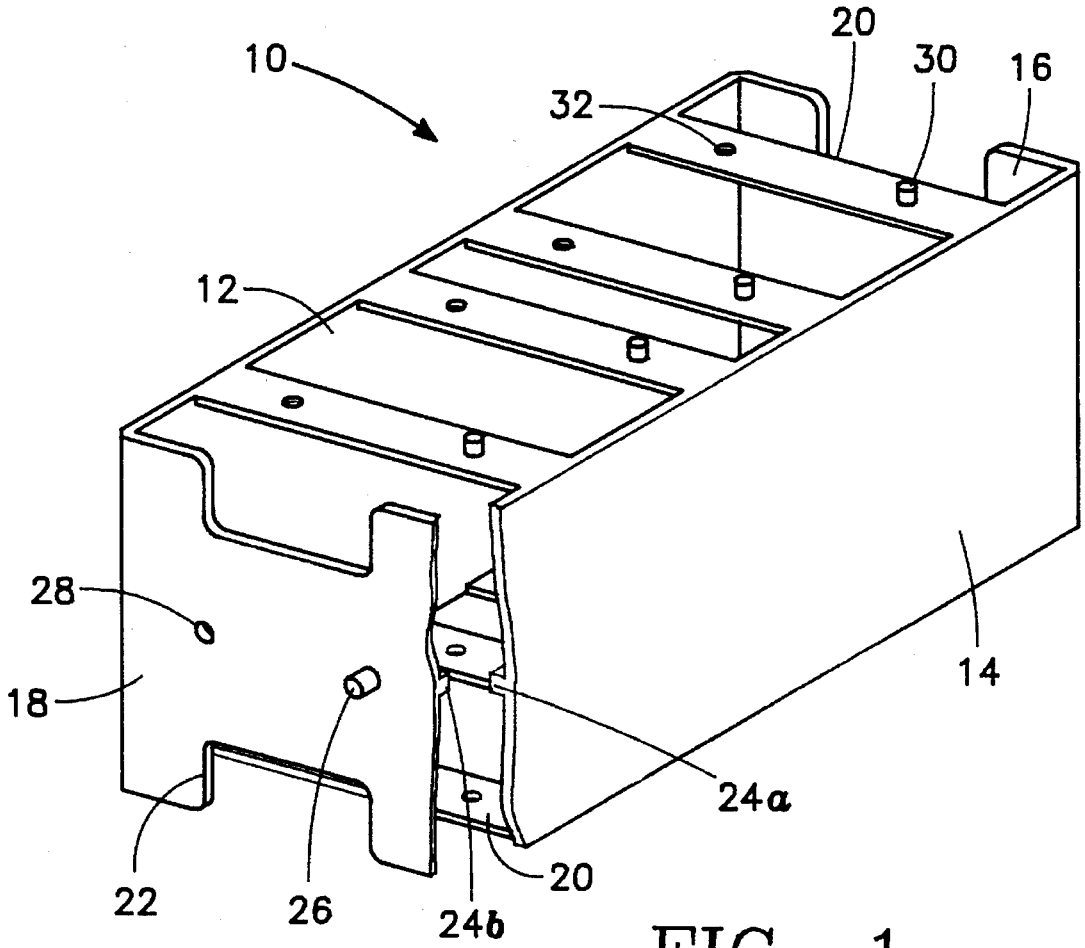
FIG. 1 is a perspective view of the molding block.

The one-piece, durable plastic molding block 10 for forming concrete structures is shown in FIG. 1. A plurality of these blocks 10 are laid in brick-like fashion to form structures, such as walls, foundations, and the like. Once the blocks 10 are in place, uncured concrete is poured inside to form an integrated concrete structure. The structure is integrated as the blocks 10 remain in place and become part of the structure adding strength thereto. The block 10 is made of a plastic material of sufficient durability as to allow it to be as thin as possible, yet still not rupture from the force put upon it by uncured concrete poured into it. Although it is not intended to limit this invention to one type of plastic material, a suitable type is 3/16 inch thick polyethylene.

The block 10 is comprised of a pair of side walls 12 and 14, and a pair of end walls 16 and 18 which form a generally rectangular shaped block with an open top and bottom. The open top and bottom are traversed by four cross straps 20 each across the shorter width of the block 10. These cross straps 20 provide lateral tensive strength to the block 10 to withstand the forces exerted by the uncured concrete after it is poured inside, and to the molded block structure once the concrete has cured. The cross straps 20 are of sufficient width to provide the necessary strength consistent with the type of plastic material chosen for the block 10 and the material's thickness.

The end walls 16 and 18 each have notches 22 at the top and bottom to allow for the installation of reinforcing iron rebar between successive blocks 10 which have been placed end-to-end to form a concrete structure. These notches also ensures that a portion of the concrete poured into the blocks 10 is common between adjacent blocks 10. This creates a monolithic configuration to the concrete structure, thereby providing for added strength.

The side walls 12 and 14, and the end walls 16 and 18 possess strengthening ribs 24*a* and 24*b* respectively which protrude perpendicular from each wall into the interior of the block 10 and run longitudinally along the entire length of each wall half way up in the vertical direction. The ribs 24*a*, 24*b* protrude a sufficient distance and are of sufficient thickness as to ensure the attached wall does not bow from the force of the uncured concrete against it.

Each end wall 16 and 18 also possesses a pin 26 and hole 28 pair which are diametrically opposed to each other along the horizontal centerline of the end wall and at points equidistant from the center of this line. The pin 26 protrudes perpendicularly from each end wall towards the exterior of the block 10. The pin 26 is sized such that when it is inserted into a hole 28 of an adjacently placed block 10 an interference fit exists. The pin 26 is of sufficient length as to protrude completely through a hole 28 of the adjacently placed block 10 and to extend slightly into the interior thereof.

Each cross strap 20 possesses a pin 30 and hole 32 pair which are diametrically opposed to each other along the longitudinal centerline of the cross strap 20 and at points equidistant from the center of this line. The pin 30 protrudes perpendicularly from each cross strap 20 towards the exterior of the block 10. The pin 30 is sized such that when it is inserted into a hole 32 of an overlying or underlying block 10, an interference fit exists. The pin 30 is of sufficient length as to protrude completely through a hole 32 of the overlying or underlying block 10 and to extend slightly into the interior thereof.

Figure 2:
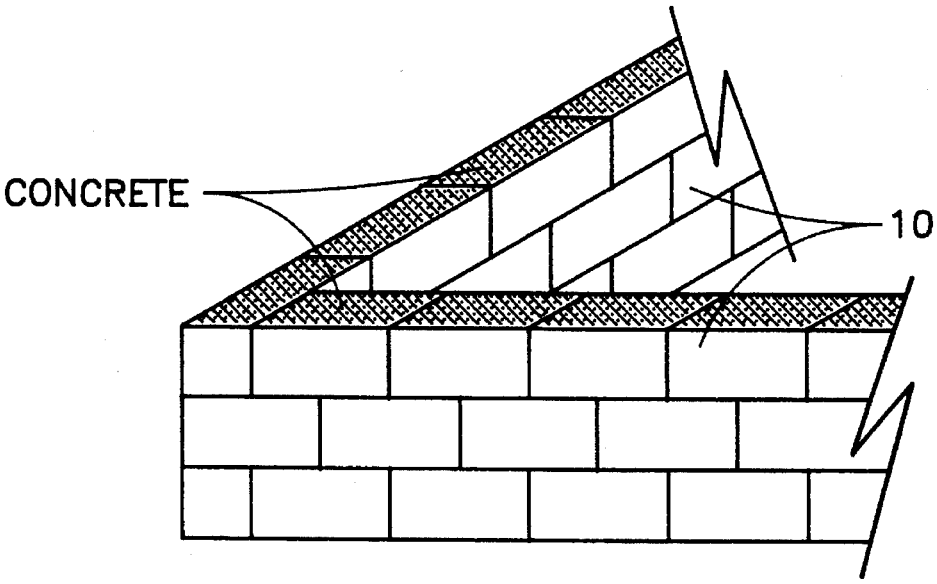
FIG. 2 shows a perspective view of the assembled concrete structure made up of a plurality of molding blocks as depicted in FIG. 1 and filled with concrete.
Figure 3:
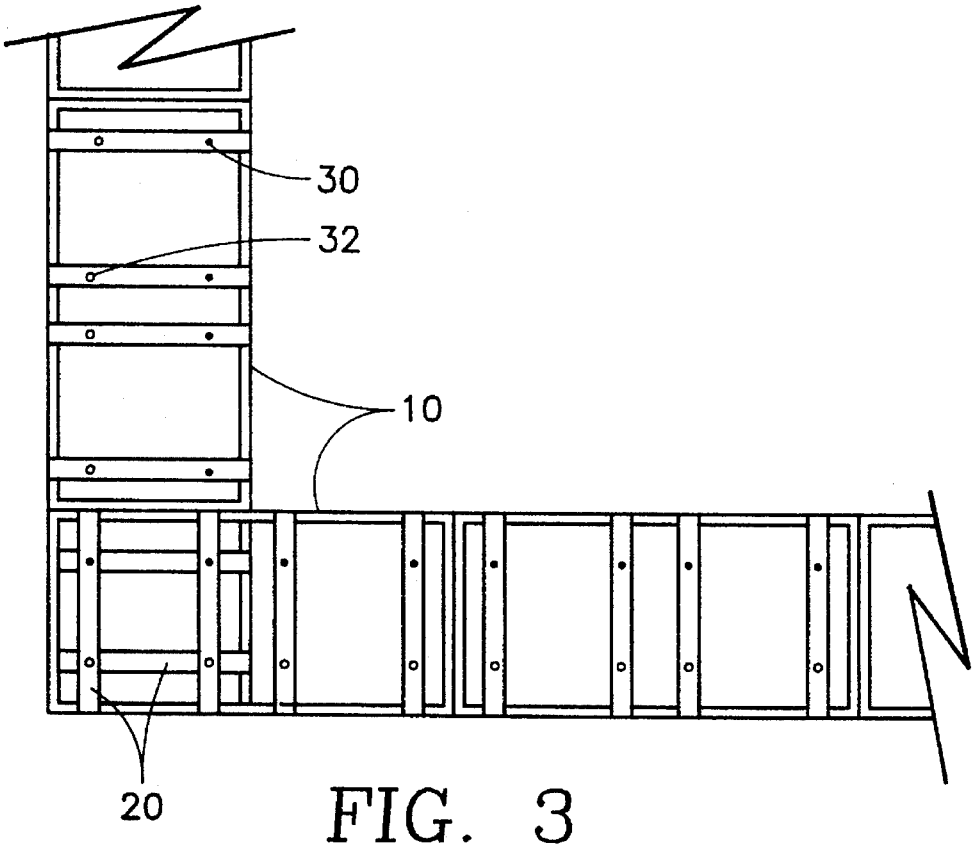
FIG. 3 shows a top view of the assembled concrete structure detailing the interconnections between a plurality of molding blocks as depicted in FIG. 1.

The straps 20 that traverse the top of the block 10 do so at positions along its longitudinal direction such that the pin 30 of each would interface with a hole 32 of a strap 20 of an overlaying block 10, and each hole 32 would interface with a pin 30 of a strap 20 of an overlying block 10. This is accomplished by ensuring the longitudinal centerlines of the first two straps 20 are equidistant from a point which is one-quarter the longitudinal length of the block from its end, and that the centerlines are spaced apart a distance equal to the separation of the centers of the pin 30 and through hole 32 on the straps 20. The other two straps 20 are similarly positioned from the opposite end of the block. The straps 20 traversing the bottom of the block 10 exists at positions mirroring the top straps 20 and interface with underlying blocks in an identical way. FIGS. 2 and 3 illustrate the way in which the blocks 10 can be stacked to form a concrete structure having the pins 30 and holes 32 of the stacked blocks 10 interfacing as just described. As can be seen in FIG. 2, each overlying block 10 overlaps one-half of the underlying block 10. Those blocks 10 which are placed at a 90 degree angle to the adjacent blocks 10 above and below at the corners of the concrete structure, similarly overlap by one-half of their lengths. FIG. 3 shows how the pins 30 and holes 32 of the straps 20 of the stacked blocks 10 interface. The pins 30 on the straps 20 of the underlying block 10 interface with the holes 32 in the straps 20 of the halves of the two blocks 10 which overlie, and the holes 32 in the straps 20 of the underlying block 10 interface with the pins 30 on the straps 20 of the overlying two blocks 10. As can be seen, the pins 30 and holes 32 interface in the above-described way regardless of whether the overlying block 10 is positioned parallel or at 90 degrees to the underlying block 10.

Figure 4:
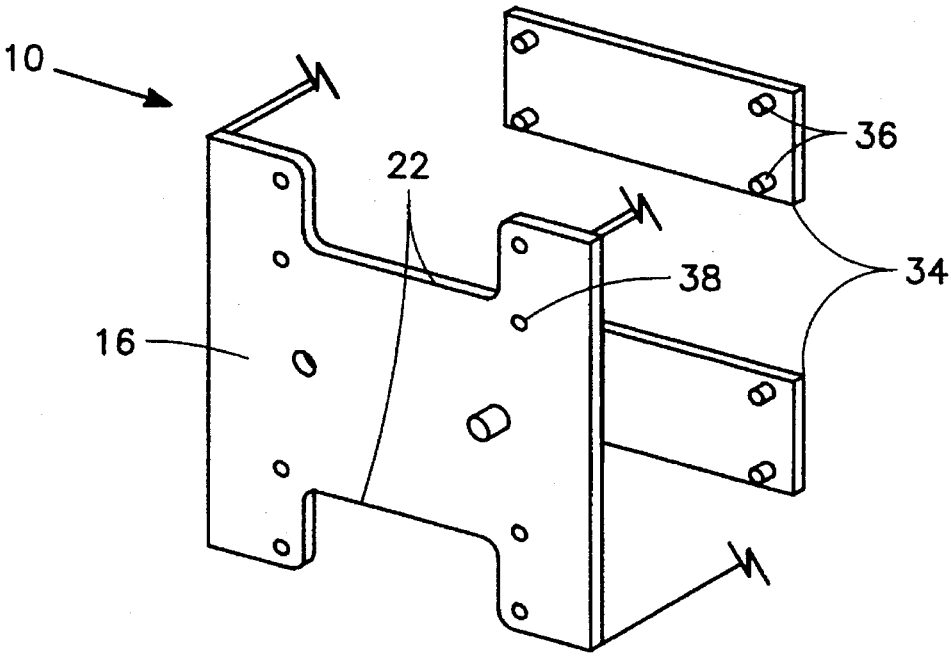
FIG. 4 shows the detailed configuration of the end plate and its connection to the molding block as depicted in FIG. 1.

In regards to those blocks 10 where one of its end walls 16 or 18 forms part of the outer surface of the concrete structure at a corner thereof, a pair of end plates 34 can be installed on the end wall 16 or 18 of block 10 such that the upper and lower notches 22 are covered over to prevent the escape of uncured concrete. As illustrated in FIG. 4, the end plate 34 has pins 36 protruding perpendicularly from its surface at each corner. The pins 36 interface with corresponding holes 38 in the end wall 16 or 18 of block 10 at each corner of the notches 22. The pins 36 are sized such that they exhibit an interference fit with the holes 38 and extend completely through the holes 38. As also shown in FIG. 4, it is preferred that the end plate 34 be installed from the inside of the block 10.

Figure 5A:
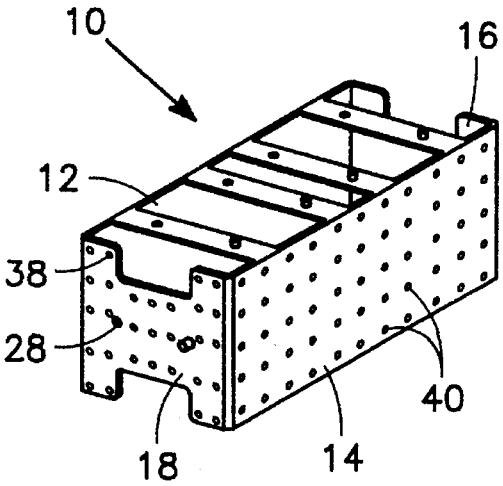
FIG. 5*a* is a perspective view of an assembled perforated version of the concrete structure made up of a plurality of molding blocks as depicted in FIG. 1 with attached plaster-type facing material.
Figure 5B:
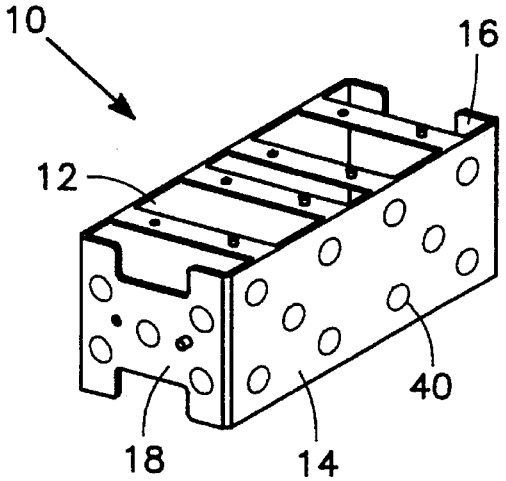
FIG. 5*b* is a perspective view of an assembled perforated version of the concrete structure made up of a plurality of molding blocks as depicted in FIG. 1 detailing the interface with adjacent molding blocks.

In one version of this invention as depicted in FIG. 5*a*, the side walls 12 and 14, and the end walls 16 and 18 of block 10 are perforated throughout their surfaces with holes 40. These holes 40 are sized so as to allow uncured concrete to flow partially through, but not completely through to the exterior surface of the wall. Although it is not intended to limit the holes 40 of this version of the invention to one particular diameter, a diameter of one-quarter inch is suggested for use with uncured concrete of typical viscosities employed in typical construction applications. This perforated version of the invention facilitates application of plaster-type surface finishes, such as stucco, to the exterior surfaces of block 10 which forms the external face of the concrete structure. The surface finish fills the remain voids within the holes 40 and bonds with the exposed concrete that has flowed partially through. The number of holes 40 in any given wall is such that there are few enough to ensure the block 10 retains sufficient strength to hold uncured concrete until it dries and provide shear resistance to prevent cracks from propagating through the dried concrete, but at the same time not so few that the surface finish's adhesion integrity is jeopardized. It is additionally noted that some of the holes 40 could be positioned so as to serve as the holes 28 and 38 in the end walls 16 and 18. In a variation of the perforated version of this invention which is depicted in FIG. 5*b*, the holes 40 in those walls of block 10 which abut other blocks 10 of the concrete structure are sized so as to allow uncured concrete to flow completely through to the exterior surface of the block 10. In this way concrete exuding from adjoining walls of the abutted blocks 10 will fuse, thereby enhancing the monolithic nature of the concrete structure.

Figure 6A:
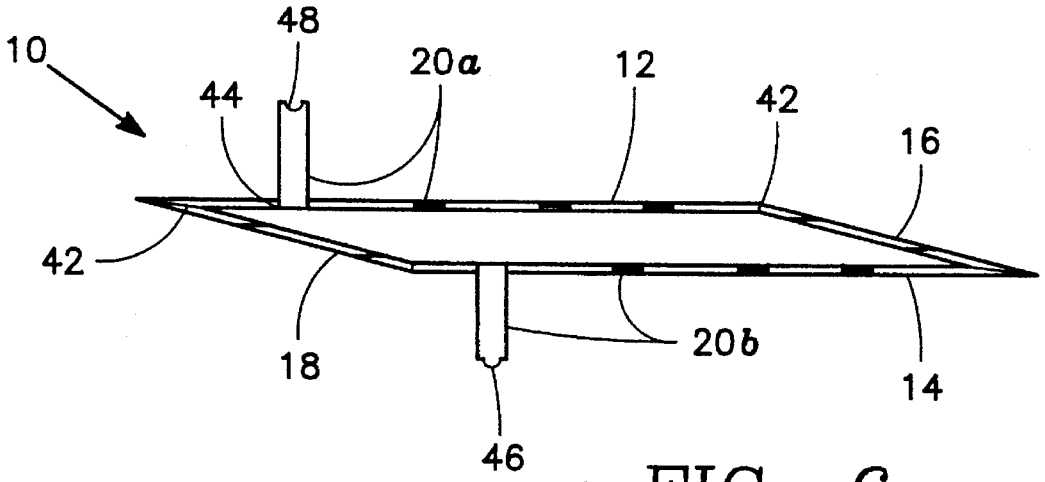
FIG. 6*a* shows a foldable version of the molding block as depicted in FIG. 1 in its folded position.
Figure 6B:
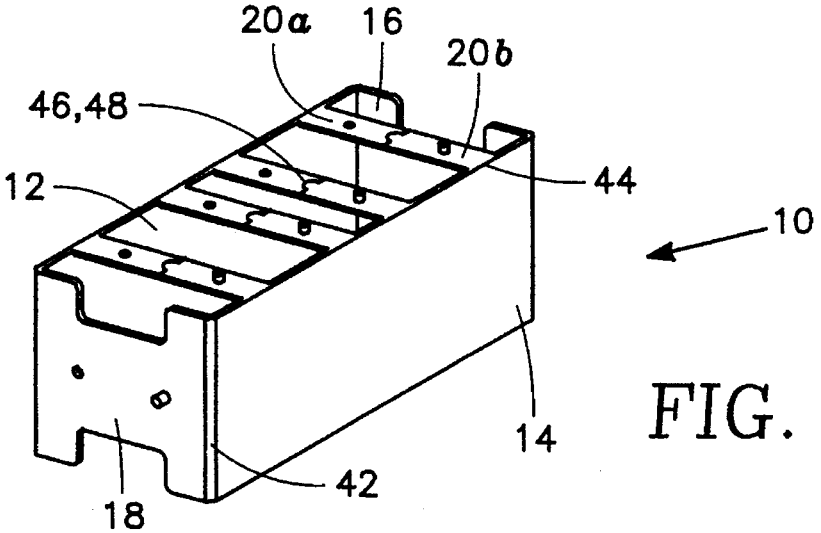
FIG. 6*b* shows a foldable version of the molding block as depicted in FIG. 1 in its unfolded position.

In another version of this invention, the block 10 is foldable so that it can be collapsed to a practically flat configuration to facilitate it packaging, shipping and storage. FIG. 6*a* shows the block 10 in the folded position and FIG. 6*b* shows it in the unfolded position. As can be seen, each side wall 12 or 14 is hingedly connected to its adjacent end wall, 16 and 18, by a living hinge 42. This living hinge 42 is not a separate element but rather is defined by a vertical elongated section in the plastic material of the block 10, at the transition between the side wall 12, 14 and the end wall 16, 18, which is of a reduced thickness from the exterior, sufficient to provide a flexible hinge. The hinge 42 is capable of allowing the rotation of the side wall 12, 14 in relation to the end wall 16, 18 such that they can form a 180 degree angle up to a 360 degree angle between their respective interior surfaces, when in the folded position, and 90 degrees apart when in the unfolded position. The cross straps 20 in this version of the invention are two-piece, 20*a* and 20*b*. Each piece thereof is hingedly connected to opposing side walls 12 and 14, by a living hinge 44. This living hinge 44 is defined by a horizontal elongated section in the plastic material of the block 10, at the transition between the side wall 12, 14 and the cross straps 20*a* , 20*b* , which is of a reduced thickness from the interior, sufficient to provide a flexible hinge. The hinge 44 is capable of allowing the rotation of a cross strap section, 20*a* or 20*b*, in relation to its adjacently connected side wall, 12 or 14, such that they can form a 90 degree angle to at least 180 degrees between their respective interior surfaces. The 90 degree angle relates to the unfolded position of the block 10, whereas the 180 degree angle relates to the folded position. When the block 10 is unfolded, the two free ends of each cross strap pair 20*a*, 20*b*, are locked together to form the requisite lateral tensive strength members discussed in other versions of this invention. The mechanism for locking a cross strap pair 20*a*, 20*b* together is comprised of an integrally formed stud 46 protruding perpendicularly from the interior facing surface on one of the strap pair members 20*a* at its free end. The stud 46 elastically deforms when it is forced through the opening of a receiver through hole 48 on the other strap pair member 20*b*. In addition, the stud 46 has sides that taper inward slightly from its end to its attachment point with the cross strap member 20*a*. The receiving through hole 48 is at the free end of the second piece of the cross strap 20*b*, and its perimeter matches the cross sectional shape of the stud at its distal end, but is slightly smaller. The interior facing surface of the free end of the side of the cross strap 20*a* with the stud 46 is recessed one-half the thickness of the cross strap 20*a*, and the exterior facing surface of the free end of the other side of the cross strap 20*b* containing the receiving through hole 48 is recessed one-half the thickness of the cross strap 20*b*. This recessed configuration results in the two pieces of the cross strap 20*a*, 20*b* having a flat, continuous surface on each face when they are locked together because the recessed surface of the first cross strap piece 20*a* contacts the recessed surface of the second cross strap piece 20*b*. The strengthening ribs 24*a* of the side walls 12, 14 are slightly offset in the vertical direction from the ribs 24*b* of the end walls 16, 18, in the foldable version of this invention. This offset prevents interference between adjacent ribs 24*a*, 24*b* when the block is folded. It is recognized that the ribs 24*a*, 24*b* will prevent the block 10 from being able to be folded flat. However, the portions of the ribs 24*a*, 24*b* adjacent the intersecting walls can be tapered or eliminated to minimize folding restriction.

The preferred version of the present invention also includes at least one lateral tensive strengthening member disposed between the side walls 12, 14 and attached thereto at approximately the centerpoint of the vertical height of the side walls 12, 14. This feature allows the thickness of the walls of the block 10 to be thinner and still withstand the forces put on them by the uncured concrete poured therein. In the foldable version of this invention, the lateral tensive strengthening members are connected to the respective side walls 12, 14 by living hinges to facilitate folding.

Figure 7A:
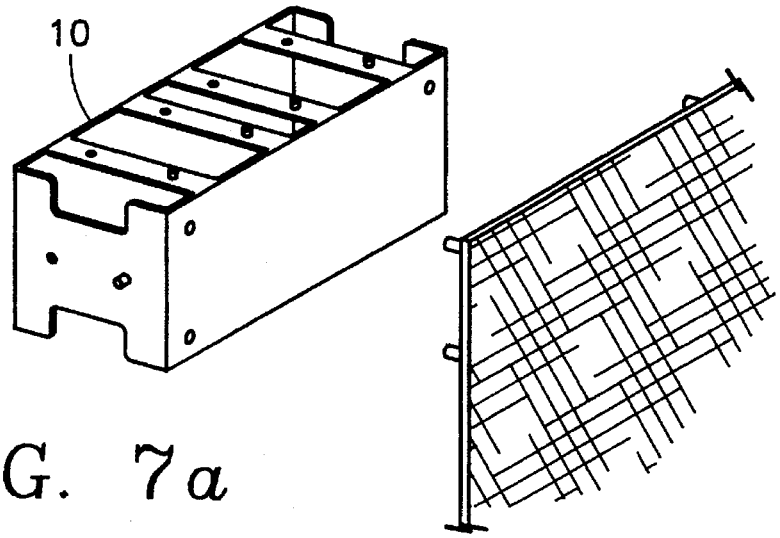
FIG. 7*a* shows a perspective view of the assembled concrete structure made up of a plurality of molding blocks as depicted in FIG. 1 detailing the interface with panel-type facing materials.
Figure 7B:
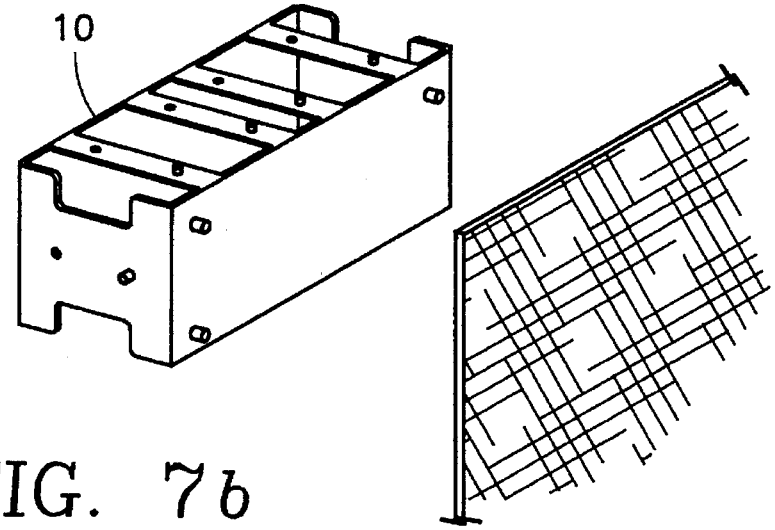
FIG. 7*b* shows a perspective view of the assembled concrete structure made up of a plurality of molding blocks as depicted in FIG. 1 detailing an alternate interface with panel-type facing materials.
Figure 8:
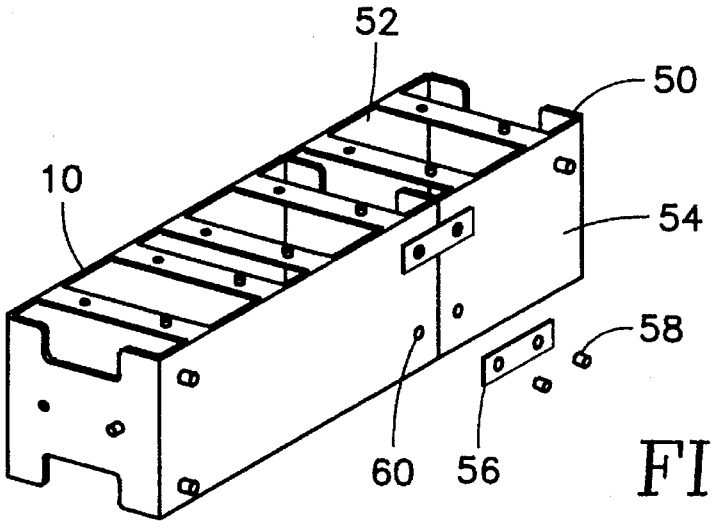
FIG. 8 shows the interface between a non-shortened block and a shortened block including the clipping means used to secure the two together.

It is noted that standard facing materials such as drywall, tileboard, plywood, or the like can be attached to the external face of the concrete structure formed by the exterior surfaces of the stacked blocks 10 just as they would to a standard concrete or cement block structure. However, in another version of this invention as depicted in FIG. 7*a*, snap-on facing materials can be employed. The snap-on facing materials would possess pins which would interface with corresponding holes in the stacked blocks 10. The facing materials would be installed prior to pouring the concrete into the blocks 10. The pins on the facing materials could be of sufficient length as to protrude significantly into the interior of a block 10. In this way the facing material would become permanently affixed to the concrete structure formed by the blocks 10. The pins could also be only long enough to reach to the interior surface of a block 10, thereby allowing the removal of the facing at a future time for replacement purposes. Alternately, as shown in FIG. *7b*, the blocks 10 themselves could possess facing pins on those surfaces forming the external portions of the concrete structure. These pins would interface with holes in the facing materials. Facing materials such as these could also be removed and replaced if desired. It is not the intention of this invention to specify the type of snap-on facing materials to be employed. However, an example would be colored plastic panels which could be varied over the surface of the concrete structure to form aesthetic designs. Another example could be stylized company logos. Still another example would be standard facing materials such as those listed above which have been modified to incorporate the snap-on feature. A further example would be specialized panels which allows for the easy removal of spray paint to eliminate graffiti.

When the blocks 10 of this invention are laid in brick-like fashion as described previously, there is often a need to shorten the longitudinal length of the last block 10 in a row of blocks 10 at the intersection of two walls of the concrete structure being constructed. The need arises when the longitudinal length of the last full block 10 in either intersecting wall is not sufficient to extend either to the outfacing surface of the concrete structure if the last block in the row is to form a portion thereof, or to the inner facing surface of the adjoining wall if the last block in the row is to abut this inner facing surface.

When the above described condition occurs, a block 10 is shortened by cutting it vertically along its side walls 12, 14 such that the longitudinal length of the now shortened sidewalls 52, 54 is equal to the gap left when the last full block 10 in the row is of insufficient length as described above.

The remaining end wall, 16 or 18, of the now shortened block 50 is then placed so as to form the above described outfacing surface or abutment. The shortened side walls 52, 54 are aligned such that the cut ends abut the endwall 16, 18 of the last full block 10 in the row, and are parallel to the sidewalls 12, 14 thereof.

The juncture made by each cut end of the shortened block 50 with the adjacent full block 10 is secured with clip means 56. The clip means 56 is placed such that it straddles the aforementioned juncture and is attached at each end to the exterior surfaces of the respective sidewalls 12, 14, 52, 54 of full block 10 and shortened block 50. The clip means 56 is attached in any appropriate manner, such as by gluing or stapling. However, it is preferred that the clip means 56 have pins 58 at each end which interface with holes 60 formed in the respective sidewalls 12, 14, 52, 54 at positions corresponding to the clip means pins 58. Any number of clip means may be used, but two per side is preferred.

Although the present invention has been described in considerable detail with reference to certain versions thereof, other versions are possible. For example, the structural framework created by the interconnection of the blocks of this invention need not be filled with concrete in order to produce a strong and permanent structure. The blocks could be filled with mud and sticks, as might be necessary in some underdeveloped countries in the world. The result is a structure whose strength would rival that of conventionally constructed concrete or cement block walls, yet be easily produced with available materials and unskilled labor.

Therefore, the spirit and scope of the appended claims should not be limited to the description of the versions of this invention contained herein.

What is claimed is:

1. A one-piece, durable plastic device for forming concrete structures wherein uncured concrete is poured into the device and the device becomes an integral part of the resulting concrete structure providing strength thereto, the device comprising:

(a) a generally rectangular shaped block having an open top and bottom comprising a pair of side walls forming the longer sides of the block and a pair of end walls forming the shorter sides of the block;

(b) a means for providing lateral tensive strengthening to the block comprising, (b1) a plurality of cross straps disposed across the open top of the block in the direction of the shortest width, the ends of which are attached to an edge of opposing side walls, and, (b2) a plurality of cross straps disposed across the open bottom of the block in the direction of the shortest width, the ends of which are attached to an edge of opposing side walls, and which are identical in number and longitudinal location as the cross straps disposed across the open top of the block; and, (c) a means for folding the block such that a first side wall and end wall is capable of being laid against a second side wall and end wall to facilitate packaging, shipping and storage, the folding means comprising, (c1) a means for hingedly connecting the side wall to an adjacent end wall such that the interior facing surface of the side wall is capable of rotating in relation to the interior facing surface of the end wall to form one of (i) a 90 degree angle, (ii) a 180 degree angle, and (iii) a 360 degree angle, where the 90 degree angle corresponds to an unfolded position, and the 180 and 360 degree angles correspond to a folded position, and wherein, (c2) each cross strap comprises a first piece and a second piece, each of which extends from the attachment to its respective side wall and is joined to the other by a means for locking the two pieces of the cross strap together, and also wherein, (c3) the attachment comprises a means for hingedly connecting the end of each piece of each cross strap to its respective side wall edge such that the interior facing surface of each cross strap piece is capable of rotating in relation to the interior facing surface of its adjacent side wall to form one of (i) a 90 degree angle, and (ii) a 180 degree angle, where the 90 degree angle corresponds to the unfolded position and the 180 degree angle corresponds to the folded position; and wherein, (d) the device is made of a plastic material which is sufficiently durable as to allow it to be as thin as possible and still strong enough to retain the uncured concrete.

2. The device of claim 1 wherein:

(a) the connecting means between the side wall and an adjacent end wall is a living hinge; and, (b) the connecting means between each cross strap piece and its adjacent side wall is a living hinge.

3. The device of claim 1 wherein the locking means between the two pieces of each cross strap comprises:

(a) an integrally formed stud protruding perpendicularly from the interior facing surface of the first piece of the cross strap at a free end, wherein the stud is elastically deformable and whose sides taper inward slightly from its distal end; and, (b) a receiving through hole at a free end of the second piece of the cross strap whose perimeter matches the cross sectional shape of the stud at its end, but is slightly smaller; and wherein, (c) the interior facing surface of the free end of the first piece of the cross strap containing the stud is recessed one-half the thickness of the cross strap; and (d) the exterior facing surface of the free end of the second piece of the cross strap containing the receiving through hole is recessed one-half the thickness of the cross strap such that when the two pieces of the cross strap are locked together the recessed surface of the first cross strap piece contacts the recessed surface of the second cross strap piece.

4. The device of claim 1 wherein:

the number of cross straps disposed across the open top and bottom of the block is four each.

5. A one-piece, durable plastic device for forming concrete structures wherein uncured concrete is poured into the device and the device becomes an integral part of the resulting concrete structure providing strength thereto, the device comprising:

(a) a generally rectangular shaped block having an open top and bottom comprising a pair of side walls forming the longer sides of the block and a pair of end walls forming the shorter sides of the block;

(b) a means for providing lateral tensive strengthening to the block; and, (c) a means for folding the block such that a first side wall and end wall is capable of being laid against a second side wall and end wall to facilitate packaging, shipping and storage; and wherein, (d) the device is made of a plastic material which is sufficiently durable as to allow it to be as thin as possible and still strong enough to retain the uncured concrete; and wherein, (e) each side wall has an attached, identically located, strengthening rib which protrudes perpendicularly into the interior of the block and is disposed longitudinally along approximately the middle of the interior facing surface of the side wall, thereby providing resistance against longitudinal bowing of the side wall;

(f) each end wall has an attached, identically located, strengthening rib which protrudes perpendicularly into the interior of the block and is disposed longitudinally along approximately the middle of the interior facing surface of the end wall, thereby providing resistance against longitudinal bowing of the end wall; and wherein, (g) the vertical height at which the strengthening rib on the side wall is disposed is offset from the vertical height at which the strengthening rib on the end wall is disposed so that they overlap when the block is in a folded position; and (h) each end of the rid on the side wall and each end of the rib on the end wall is tapered so that folding of the block is not significantly interfered with.

6. A one-piece, durable plastic device for forming concrete structures wherein uncured concrete is poured into the device and the device becomes an integral part of the resulting concrete structure providing strength thereto, the device comprising:

(a) a generally rectangular shaped block having an open top and bottom comprising a pair of side walls forming the longer sides of the block and a pair of end walls forming the shorter sides of the block;

(b) a means for providing lateral tensive strengthening to the block comprising, (b1) a plurality of cross straps disposed across the open top of the block in the direction of the shortest width, the ends of which are attached to an edge of opposing side walls, and, (b2) a plurality of cross straps disposed across the open bottom of the block in the direction of the shortest width, the ends of which are attached to an edge of opposing side walls, and which are identical in number and longitudinal location as the cross straps disposed across the open top of the block; and, (c) a means for folding the block such that a first side wall and end wall is capable of being laid against a second side wall and end wall to facilitate packaging, shipping and storage; and wherein, (d) the device is made of a plastic material which is sufficiently durable as to allow it to be as thin as possible and still strong enough to retain the uncured concrete; and wherein, (e) each cross strap disposed over the open top of the block has a first means for connecting it to the cross strap of an overlying block; and, (f) each cross strap disposed over the open bottom of the block has a second means for connecting it to the cross strap of an underlying block; and wherein, (g) the longer dimension of the overlying block can be one of (i) parallel to the longer dimension of the top of the block and offset by one-half of its length, and (ii) at a 90 degree angle to the longer dimension of the top of the block and but offset by one-half of its length.

7. The device of claim, 6 wherein:

(a) the first cross strap connecting means is identical to the second cross strap connecting means, and comprises, (a1) a through hole, (a2) a perpendicularly protruding pin on the exterior facing surface of the cross strap, capable of creating an interference fit with the through hole of the cross strap of an adjacently placed block, and extending slightly into the interior thereof; wherein, (a3) the through hole and pin are diametrically opposed to each other along the longitudinal centerline of the cross strap and equidistant from the center of that line; and wherein, (b) a first two of the cross straps that are disposed over the open top of the block are affixed along the block's longitudinal direction such that the longitudinal centerlines of the first two of the cross straps are equidistant from a point which is one-quarter the longitudinal length of the block from one of its ends, and the centerlines are spaced apart a distance equal to the separation of the centers of the pin and the through hole on each of the first two of the cross straps;

(c) a second two of the cross straps disposed over the top of the block are affixed identically as the first two of the cross straps except from the opposite end of the block; and, (d) the cross straps disposed over the open bottom of the block are positioned so as to mirror the cross straps disposed over the open top of the block.

8. A one-piece, durable plastic device for forming concrete structures wherein uncured concrete is poured into the device and the device becomes an integral part of the resulting concrete structure providing strength thereto, the device comprising:

(a) a generally rectangular shaped block having an open top and bottom comprising a pair of side walls forming the longer sides of the block and a pair of end walls forming the shorter sides of the block;

(b) a means for providing lateral tensive strengthening to the block; and, (c) a means for folding the block such that a first side wall and end wall is capable of being laid against a second side wall and end wall to facilitate packaging, shipping and storage; and wherein, (d) the device is made of a plastic material which is sufficiently durable as to allow it to be as thin as possible and still strong enough to retain the uncured concrete; and wherein, (e) each end wall has an identically located notch at its top and bottom providing for the installation of reinforcing bars across the longitudinal length of the block.

9. The device of claim 8 wherein:

the notches can be covered to prevent the escape of uncured concrete by a end plate which includes means to connect to the end wall.

10. A one-piece, durable plastic device for forming concrete structures wherein uncured concrete is poured into the device and the device becomes an integral part of the resulting concrete structure providing strength thereto, the device comprising:

(a) a generally rectangular shaped block having an open top and bottom comprising a pair of side walls forming the longer sides of the block and a pair of end walls forming the shorter sides of the block;

(b) a means for providing lateral tensive strengthening to the block; and, (c) a means for folding the block such that a first side wall and end wall is capable of being laid against a second side wall and end wall (d) the device is made of a plastic material which is sufficiently durable as to allow it to be as thin as possible and still strong enough to retain the uncured concrete; and wherein, (e) each end wall has a means for connecting it to the end wall of an adjacently placed block, the connecting means comprising, (e1) a through hole;

(e2) a perpendicularly protruding pin on the exterior facing surface of the end wall, capable of creating an interference fit with the through hole of an adjacently placed block, and extending slightly into the interior thereof; and, (e3) the through hole and pin are diametrically opposed to each other along the horizontal centerline of the end wall and equidistant from the center of that line.

* * * * *